US010501897B1

(12) United States Patent
Thiesse et al.

(10) Patent No.: US 10,501,897 B1
(45) Date of Patent: Dec. 10, 2019

(54) SYSTEMS AND METHODS FOR SPRAY BAR CONTROL IN PAVING MACHINE

(71) Applicant: Caterpillar Paving Products Inc., Brooklyn Park, MN (US)

(72) Inventors: Chad M. Thiesse, Brooklyn Park, MN (US); Andrea Fontana, Porto Tolle (IT)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/132,822

(22) Filed: Sep. 17, 2018

(51) Int. Cl.
*E01C 19/48* (2006.01)
*E01C 19/17* (2006.01)

(52) U.S. Cl.
CPC ..... *E01C 19/48* (2013.01); *E01C 19/174* (2013.01); *E01C 19/176* (2013.01)

(58) Field of Classification Search
CPC ..... E01C 19/48; E01C 19/174; E01C 19/176
USPC ..... 404/84.05, 111, 118
See application file for complete search history.

(56) References Cited

U.S. PATENT DOCUMENTS

| | | | | |
|---|---|---|---|---|
| 8,061,931 | B2 | 11/2011 | Musil | |
| 2008/0124173 | A1* | 5/2008 | Buschmann | E01C 19/176 404/111 |
| 2009/0257824 | A1* | 10/2009 | Musil | E01C 19/174 404/79 |
| 2010/0256878 | A1 | 10/2010 | Zegowitz | |
| 2014/0119826 | A1* | 5/2014 | Graham | E01C 19/42 404/75 |

FOREIGN PATENT DOCUMENTS

| | | |
|---|---|---|
| CN | 106087661 | 11/2016 |
| CN | 205954451 | 2/2017 |
| CN | 107190620 | 9/2017 |

* cited by examiner

*Primary Examiner* — Raymond W Addie
(74) *Attorney, Agent, or Firm* — Schwegman, Lundberg & Woessner

(57) ABSTRACT

Systems and methods for spraying control in a paving machine comprise a screed system having an adjustable width, a position sensor configured to sense widths of the screed system, a spray bar having adjustable positions, a spray bar actuator to adjust positions of the spray bar, a spray bar sensor to sense positions of the spray bar, and a controller coupled to the position sensor, spray bar actuator and spray bar sensor that is configured to adjust the spray bar actuator depending on the sensed width. The spray bar sensor and actuator can be integrated together.

20 Claims, 6 Drawing Sheets

SYSTEMS AND METHODS FOR SPRAY BAR CONTROL IN PAVING MACHINE

TECHNICAL FIELD

The present application relates generally, but not by way of limitation, to control systems and methods for paving machines, such as those that can be used to produce paved roadway surfaces. More particularly, the present application relates to control systems and methods for emulsion and tack coat spraying systems used on paving machines.

BACKGROUND

Some road paving machines can include systems for spraying a coating onto a roadway surface. For example, a tack coating can be applied over a base course before application of a top wear course to, for example, facilitate bonding of the top wear course to the base course. While driving over the base course, a road paving machine can directly apply the tack coating to the base course and thereafter spread the top wear course over the tack coating.

Because each roadway being produced can have different parameters. such as thickness and width, it can be advantageous to adjust the position of various paving system components for a particular project to match the roadway being produced. Road paving machines can also utilize multiple sensor systems to assist in pouring and spreading paving material to form the roadway surface. For example, road paving machines can utilize sensors to determine road grade, material depth and material feed rate. Sometimes, the adjustment of the paving system component is a manual process and any associated sensing systems are sometimes adjusted in a corresponding manner.

U.S. Publication No. 2010/0256878 to Zegowitz, entitled "Road Finisher," discloses a Radio Frequency Identification (RFID) system that can be used with a spray bar of a road finisher.

SUMMARY OF THE INVENTION

A system for controlling spray width in a paving machine can comprise a screed system having an adjustable width, a first position sensor configured to sense a first width of the screed system, a first spray bar having a position that is adjustable, a first spray bar actuator configured to adjust the position of the first spray bar, and a controller electronically coupled to the first position sensor and the first spray bar actuator, the controller configured to adjust the first spray bar actuator depending on the first width sensed by the first position sensor.

A spray system for a paving machine can comprise a spray bar, a mount connected to the spray bar for coupling the spray bar to the paving machine, a plurality of spray nozzles coupled to the spray bar, an actuator coupled to the spray bar, wherein the actuator includes a position sensor to sense a position of the actuator, and a controller configured to determine an orientation of the spray bar relative to the mount and a number of spray nozzles of the plurality of spray nozzles that should be activated based on output of the position sensor.

A method for spraying a coating during a paving machine operation can comprise sensing a paving width of a screed system, determining a position of a spray bar from a position sensor attached to the spray bar, adjusting an actuator incorporating the position sensor and coupled to the spray bar to change the position of the spray bar to adjust to the paving width, and calculating a spray width for the spray bar based on the paving width.

DETAILED DESCRIPTION

Figure 1:
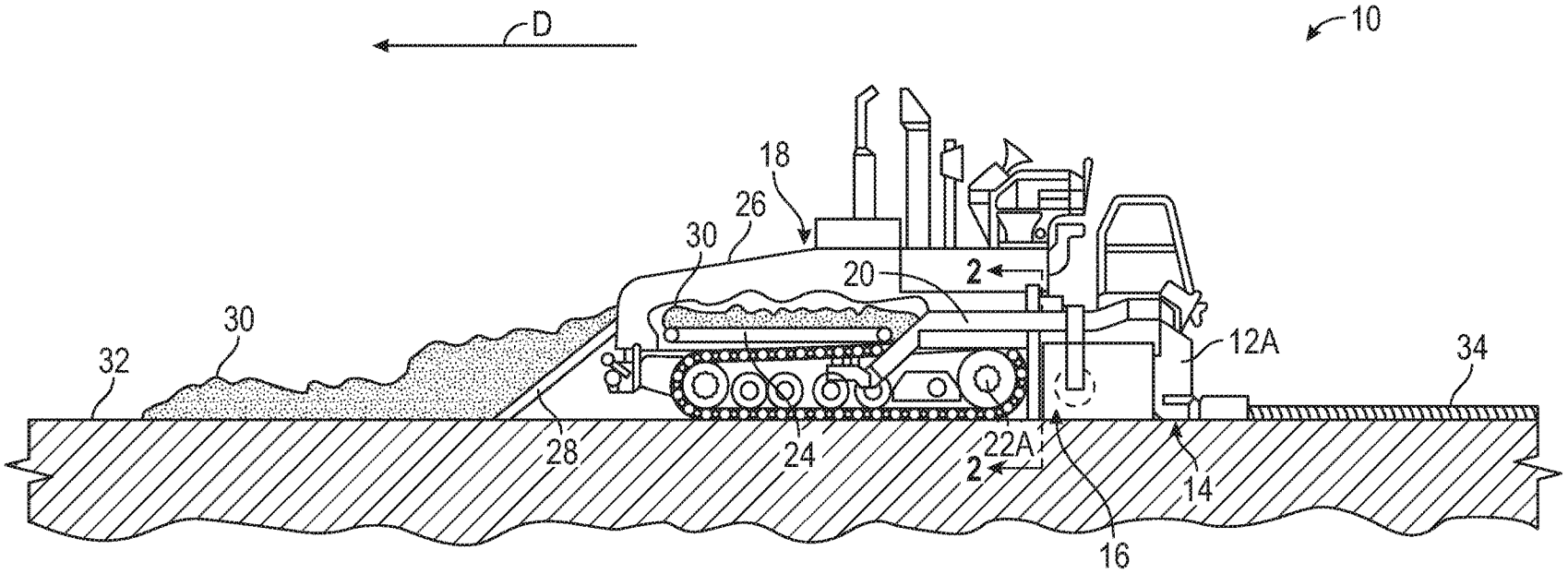
FIG. 1 is a schematic side view of a paving machine showing portions of a screed system, an auger system and a spray system.
Figure 3:
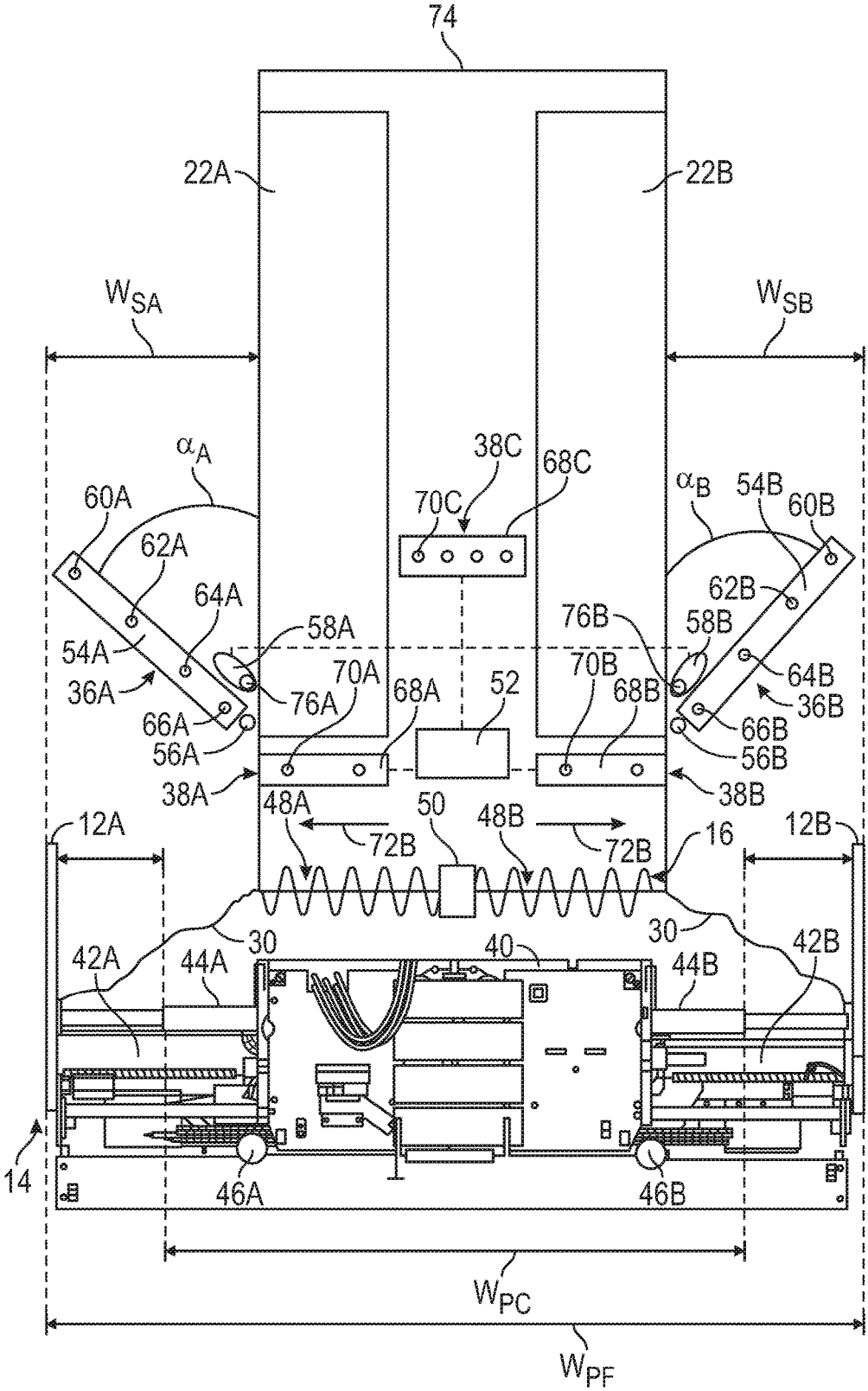
FIG. 3 is a diagrammatic plan view of the paving machine of FIG. 1 showing the fixed and adjustable spray bars of FIG. 2 relative to the screed system and the auger system.

FIG. 1 is a schematic side view of paving machine 10 showing screed side plate 12A of screed system 14 positioned rearward of auger system 16. A portion of spray system 17 is also shown forward of auger system 16. Asphalt paving machine 10 can comprise vehicle portion 18, which can be connected to screed system 14 via tow arm 20. A second tow arm 20 (not shown) can also be provided to support the opposite side of screed system 14. As shown in FIG. 3, paving machine 10 can additionally comprise side plate 12B such that an adjustable paving width can be defined between side plates 12A and 12B. Vehicle portion 18 can additionally comprise propulsion element 22A, conveyor system 24, hopper 26 and elevator 28.

Loose paving material 30 can be deposited onto work surface 32 via a dump truck or other suitable means. Work surface 32 can comprise a base course upon which a top wear course can be applied, such as mat 34. Paving machine 10 can include means for moving loose paving material 30 into hopper 26, such as elevator 28. Paving material 30 can be asphalt, aggregate materials or concrete. In various embodiments, paving material 30 can be deposited directly into hopper 26 of paving machine 10. Paving machine 10 can travel in paving direction D, while conveyor system 24 can move paving material in the opposite direction from hopper 26 to auger system 16.

Conveyor system 24 can be disposed within or below hopper 26. Conveyor 26 can transport loose paving material 30 through vehicle portion 18 toward auger system 16. A grading implement, such as screed system 14, can be attached to the rear of vehicle portion 18 to receive paving material 30 from auger system 16. Screed system 14 can be towed by a plurality of tow arms 20, only one of which is shown in FIG. 1. Propulsion system 22A and propulsion system 22B (FIG. 3) can comprise a ground engaging element, such as an endless track as shown in FIG. 1, wheels or the like for propelling paving machine 10 along work surface 32. Loose paving material 30 can be deposited by conveyor system 24 in front of auger system 16. Auger system 16 can disperse loose paving material 30 along the paving width (into the plane of FIG. 1) of screed system 14 between side plates 12A and 12B. Screed system 14 can compact loose paving material 30 into mat 34 behind paving machine 10.

Figure 2:
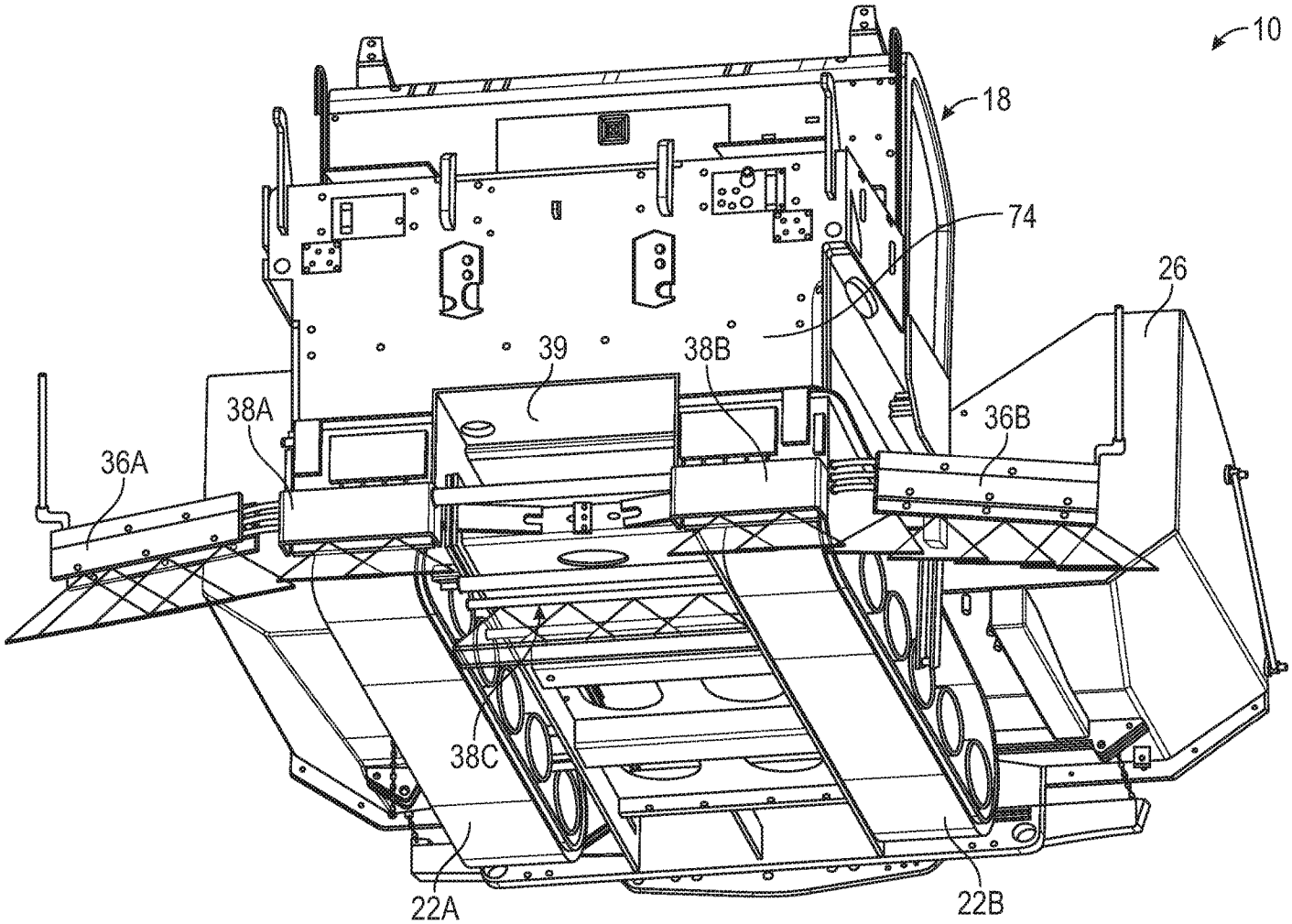
FIG. 2 is a perspective view of the paving machine of FIG. 1 with the screed system removed to show left, right and center fixed spray bars and left and right adjustable spray bars of the spray system.

Paving machine 10 can include spray system 17 for applying a coating, such as a tack coat or an emulsion, between work surface 32 and mat 34. As shown in FIG. 2, spray system 17 can include various spraying sections to apply the coating across the full width of work surface 32. Spray bar 36A can be configured to spray the coating underneath the portion of mat 34 applied by screed system 14 extending out to side plate 12A. As shown in FIGS. 2 and 3, spray bar 36B can be configured to spray the coating underneath the portion of mat 34 applied by screed system 14 extending out to side plate 12B. Spray bars 36A and 36B can be adjusted, such as by controller 52 (FIG. 3) of paving machine 10 to adjust a spray width of spray system 17 to correlate with the paving width adjusted between side plates 12A and 12B.

FIG. 2 is a perspective view of paving machine 10 of FIG. 1 with screed system 14 removed to show left and right adjustable spray bars 36A and 36B and left, right and center fixed spray bars 38A, 38B and 38C of spray system 17. Paving machine 10 can comprise propulsion elements 22A and 22B, which can be mounted to the underside of vehicle portion 18. Hopper 26 can be mounted to vehicle portion 18 above propulsion elements 22A and 22B.

As discussed with reference to FIG. 1, propulsion elements 22A and 22B are configured to move paving machine 10 forward (into the plane of FIG. 2) while conveyor system 24 (FIG. 1) moves paving material 30 through opening 39 in vehicle portion 18. Conveyor system 24 is configured to deposit paving material behind (relative to the view of FIG. 1) spray bars 36A, 36B and 38A-38C, into screed system 14. As such, spray bars 36A, 36B and 38A-38C can produce a layer of sprayed material onto the surface to which paving material 30 is deposited, e.g., work surface 32 (FIG. 1).

As discussed with reference to FIG. 3, each of spray bars 36A, 36B and 38A-38C can include a body or structural component that can be mounted to vehicle portion 18 and a plurality of spray nozzles mounted to each structural component. Each of spray bars 36A, 36B and 38A-38C can additionally be attached to piping or conduit to receive a liquid or emulsion to be sprayed. The conduit can be fluidly coupled to a container or reservoir of the liquid or emulsion stored in or carried by vehicle portion 18. In other examples, the conduit can be fluidly coupled to a container or reservoir of the liquid or emulsion carried by another vehicle configured to drive alongside paving machine 10. The liquid or emulsion can be pressurized by, for example, a pump for dispensing through a plurality of nozzles mounted to each of spray bars 36A, 36B and 38A-38C. Operation of spray bars 36A, 36B and 38A-38C to dispense the fluid can be controlled by controller 52 (FIG. 3) of paving machine 10.

Spray bars 38A-38C can comprise fixed spray bars in that they can be configured to spray over a fixed width. As such, spray bars 38A-38C can be fixedly attached to vehicle portion 18, i.e., such that the spray bar structural components are immobilized relative to vehicle portion 18. However, spray bars 38A-38C can be configured to be adjustable if desired, such as to spray with fewer than all of the spray nozzles attached thereto. In the illustrated example of FIG. 2, spray bars 38A and 38B can be configured with two spray nozzles to emit two spray streams, while spray bar 38C can be configured with four spray nozzles to emit four spray streams.

In an example, spray bars 38A and 38B can be configured to spray the widths of propulsion units 22A and 22B, respectively, and spray bar 38C can be configured to spray the width of the space between propulsion units 22A and 22B. Spray bars 36A and 36B can be configured to spray variable lengths beyond the widths of propulsion units 22A and 22B that can correspond to widths that side plates 12A and 12B extend screed system 14. Spray bars 36A and 36B can be coupled to a frame of vehicle portion 18, such as at pivot point, to allow the distances that spray bars 36A and 36B extend out beyond propulsion units 22A and 22B to be varied. As discussed with reference to FIG. 3, spray bars 36A and 36B can be coupled to actuators that can incorporate position sensors that can facilitate positional and spray adjustments of spray bars 36A and 36B based on, for example, a sensed width between side plates 12A and 12B.

FIG. 3 is a diagrammatic plan view of paving machine 10 of FIG. 1 showing adjustable spray bars 36A and 36B and fixed spray bars 38A-38C of FIG. 2 relative to screed system 14 and auger system 16. Screed system 14 can comprise side plates 12A and 12B, main housing 40. screed extenders 42A and 42B, actuators 44A and 44B and screed extender sensors 46A and 46B. Auger system 16 can comprise augers 48A and 48B and gearbox 50.

Spray system 17 can comprise adjustable spray bars 36A and 36B, fixed spray bars 38A-38C and controller 52. Spray bar 36A can comprise housing 54A, hinge 56A, actuator 58A, and spray nozzles 60A, 62A, 64A and 66A. Spray bar 36B can comprise housing 54B, hinge 56B, actuator 58B, and spray nozzles 60B, 62B, 64B and 66B. Spray bar 38A can comprise housing 68A and spray nozzles 70A. Spray bar 38B can comprise housing 68B and spray nozzles 70B. Spray bar 38A can comprise housing 68C and spray nozzles 70C.

Side plates 12A and 12B can be connected to main housing 40 via screed extenders 42A and 42B. The position of screed extenders 42A and 42B can be adjusted relative to main housing 40 by actuators 44A and 44B, respectively. Main housing 40 and propulsion units 22A and 22B can be connected to frame 74, which is schematically illustrated in FIG. 3 for clarity, of vehicle portion 18 (FIG. 1). Adjustable spray bars 36A and 36B and fixed spray bars 38A-38C can be attached to frame 74 of vehicle portion 18. Housing 68A of spray bar 38A can be attached behind propulsion unit 22A. Housing 68B of spray bar 38B can be attached behind propulsion unit 22B. Housing 68C of spray bar 38C can be attached between propulsion units 22A and 22B. Housing 54A of spray bar 36A can be attached to frame 74 via hinge 56A or another pivot mechanism. Housing 54B of spray bar 36B can be attached to frame 74 via hinge 56B or another pivot mechanism. Although the present application is described with reference to pivoting spray bars, the systems and methods described herein can be applied to other types of spray bars, such as telescoping spray bars. The positions of housings 54A and 54B can be adjusted by actuators 58A and 58B, respectively, which can be in electronic communication with controller 52. The positions of housings 54A and 54B can be sensed and determined by position sensors 76A and 76B, which can be integrated directly into actuators 58A and 58B, respectively. Additionally, operation of individual nozzles 60A-66B and 70A-70C of spray system 17 can be controlled by controller 52. For example, each of nozzles 60A-66B and 70A-70C can be individually turned on or off (e.g., opened or closed) to permit flow of fluid in an on/off configuration. In other examples, each of nozzles 60A-66B and 70A-70C can be pulsed or incrementally opened to partially opened states between being fully closed and fully opened.

Screed system 14 can operate so that paving material 30 can be pushed laterally outward in opposite first and second directions, as indicated by arrows 72A and 72B. Augers 48A and 48B, which can comprise two sections of auger rotating in opposite directions via gearbox 50, can be rotated at a suitable speed to provide enough paving material to extend the full width between side plates 12A and 12B, and to provide mat 34 (FIG. 1) with sufficient thickness. As such, an operator of asphalt paving machine 10 can enter operator inputs, such as at controller 52, for a target head (or height) of paving material 30 in front of screed system 14 to control the speed of augers 48A and 48B and the speed of conveyor system 24. Actuators 44A and 44B can change the distance between augers 48A and 48B and side plates 12A and 12B for providing different widths of mat 34 depending on, for example, the width of a roadway to be paved.

Spray system 17 can operate to provide a coating of sprayed material on work surface 32 for placement underneath mat 34 for different widths of mat 34 applied by screed system 14 depending on the distance separating side plates 12A and 12B. In various examples, controller 52 can determine the paving width, which can vary any where from full paving width $W_{PF}$ to compact paving width $W_{PC}$ between side plates 12A and 12B, depending on the position of actuators 44A and 44B. Sensors 46A and 46B can be configured to sense and determine the position of actuators 44A and 44B, respectively, and hence the position of side plates 12A and 12B, to determine the actual paving width. For example, sensors 46A and 46B can sense when actuators 44A and 44B are fully extended, which controller 52 can use, e.g., by reception of sensor signals from sensors 46A and 46B, to determine that screed system 14 is operating at full paving width $W_{PF}$. Likewise, sensors 46A and 46B can sense when actuators 44A and 44B are fully contracted, which controller 52 can use, e.g., by reception of sensor signals from sensors 46A and 46B, to determine that screed system 14 is operating at compact paving width $W_{PC}$. Sensors 46A and 46B can additionally sense intermediate positions for partial paving widths.

Controller 52 can receive signals from sensors 46A and 46B to determine the paving width and subsequently determine the spraying width for adjustable spray bars 36A and 36B. FIG. 3 illustrates, for example, spray bars 36A and 36B in a fully extended position to fully cover full paving width $W_{PF}$. As such, spray bar 36A can be configured to spray over spray width $W_{SA}$ and spray bar 36B can be configured to spray over spray width $W_{SB}$. Spray widths $W_{SA}$ and $W_{SB}$ can be calculated, such as with controller 52, using spray bar angles $\alpha_A$ and $\alpha_B$. That is, controller 52 can be programmed with known lengths of spray bars 36A and 36B and sensors 76A and 76B can determine angles $\alpha_A$ and $\alpha_B$ to determine widths $W_{SA}$ and $W_{SB}$. In such positions, controller 52 can operate all of spray nozzles 60A-66A and spray nozzles 60B-66B to cover full paving width $W_{PF}$ with material. Spray bars 36A and 36B can be retracted by actuators 58A and 58B, respectively, to move spray bars 36A and 36B closer to frame 74 to only fully cover compact paving width $W_{PC}$. In such a position, controller 52 can operate, for example, only spray nozzles 66A and 66B to cover compact paving width $W_{PC}$ with material. As such, as full paving width $W_{PF}$ becomes progressively smaller to compact paving width $W_{PC}$, controller 52 can progressively deactivate or close spray nozzles 60A and 60B, 62A and 62B, and 64A and 64B until compact paving width $W_{PC}$ is reached.

Figure 4:
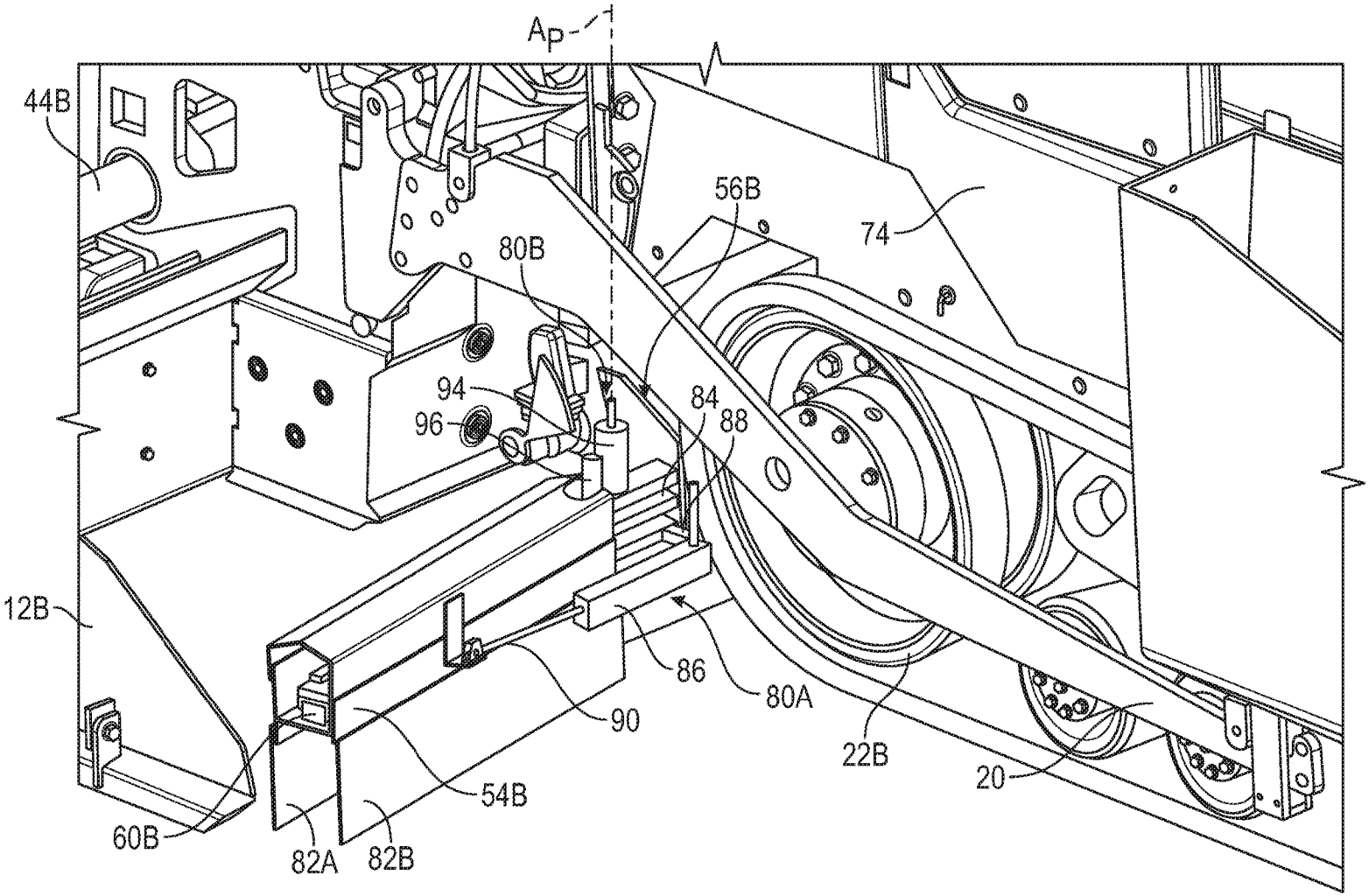
FIG. 4 is a perspective view of a paving machine of the present application including an adjustable sidebar having various embodiments of actuators having integrated position sensors.

FIG. 4 is a perspective view of paving machine 10 including adjustable spray bar 36B having alternative embodiments of actuator 58B having integrated position sensors. In FIG. 4, actuator 58B can comprise cylinder mechanism 80A or motor mechanism 80B. In the embodiment of FIG. 4, spray bar 36B can comprise housing 54B, hinge 56B, a plurality of nozzles including nozzle 60B and side flaps 82A and 82B.

Hinge 56B can comprise a plurality of interlocking tabs 84 extending alternately from frame 74 and housing 54B with a pin extending therethrough. Hinge 56B can be configured to rotate housing 54B at pivot axis $A_P$.

Cylinder mechanism 80A can be mounted alongside hinge 56B. Cylinder mechanism 80A can comprise cylinder 86 that can be mounted to frame 74, such as at tab 88. Rod 90 can extend from cylinder 86 and can be configured to move under hydraulic or pneumatic power. Activation of rod 90 can cause housing 54B to rotate at pivot axis $A_P$ at hinge 56B. Cylinder mechanism 80A can include an integral position sensor. e.g., sensor 76B, that can determine the distance that rod 90 is extended from cylinder 86. As such, the distance of rod 90 can be used to determine angle $\alpha_B$, which can be used to determine $W_{SB}$, which can be based on geometry of spray system 17 stored in controller 52. In other examples, control system 100 can determine the amount of hydraulic fluid or air that is provided to cylinder mechanism 80A in order to determine the position of rod 90 relative to cylinder 86 such that the distance of rod 90 can be determined without the use of a sensor.

Motor mechanism 80B can be mounted above hinge 56B. Motor mechanism 80B can comprise stepper motor 94 that can be mounted to frame 74 on one or more of tabs 84. Stepper motor 94 can be attached to housing 54B with linkage 96. Activation of stepper motor 94 can cause housing 54B to rotate at pivot axis $A_P$ at hinge 56B. Motor mechanism 80B can include an integral rotation sensor, e.g., sensor 76B, that can determine the amount that linkage 96 is rotated relative to tabs 84. As such, the rotational position of stepper motor 94 can be used to determine angle $\alpha_B$, which can be used to determine $W_{SB}$, which can be based on geometry of spray system 17 stored in controller 52.

Figure 5:
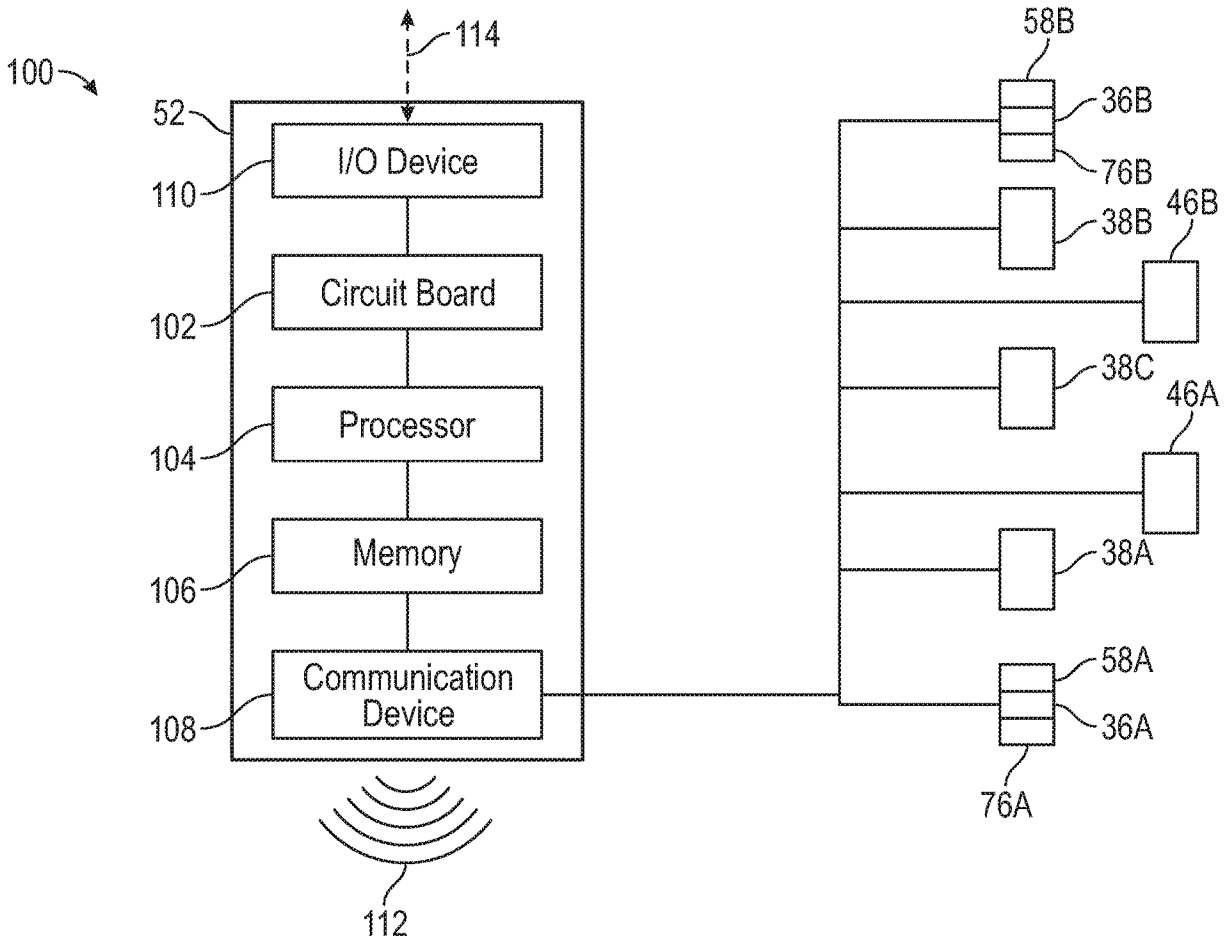
FIG. 5 is a schematic diagram of a control system for a paving machine including a screed system and a spraying system.

FIG. 5 is a schematic diagram of control system 100 for paving machine 10 including screed system 14 and spraying system 17. Control system 100 can comprise controller 52, spray bars 36A and 36B, spray bars 38A-38C, screed extender sensors 46A and 46B, actuators 58A and 58B and position sensors 76A and 76B. Spray bars 36A. 36B, 38A, 38B and 38C can include nozzles 60A-66B and 70A-70C as described above, but are omitted from FIG. 5 for clarity.

Controller 52 can comprise circuit board 102, processor 104, memory 106, communication device 108 and input/output (I/O) device 110.

Circuit board 102 can comprise a control board for paving machine 10 include spray system 17. Circuit board 102 can comprise a structural component for coupling electrical components of controller 52. For example, circuit board 102 can comprise a silicon wafer into which electrical couplings are attached for coupling processor 104, memory 106 and the like. Circuit board 102 can include circuitry that can direct power from a power source (not illustrated) to any of the components of controller 52, paving machine 10 or spray system 17.

Processor 104 can comprise an integrated circuit that controls operation of components of controller 52, such as I/O device 110 and communication device 108. Processor 104 can execute instructions stored, in memory 106 for example, to calculate the various parameters described herein such as $\alpha_A$, $\alpha_B$, $W_{SA}$, $W_{SB}$, $W_{PF}$ $W_{PC}$ based on, for example, the geometries of paving machine 10, screed system 14 and spray system 17 stored in memory 106.

Memory 106 can comprise any suitable storage device, such as non-volatile memory, magnetic memory, flash memory, volatile memory, programmable read-only memory and the like. Memory 106 can include instructions stored therein for processor 104 to control operation of paving machine 10 and spray system 17. For example, memory 106 can include instructions for performing the steps and functions illustrated and described with reference to FIG. 6.

Communication device 108 can include circuitry to perform wireless communications, such as Bluetooth, low-energy Bluetooth, near-field communication (NFC), or IEEE 802.11 (Wi-Fi), Zigbee, infrared (IR), 3GPP or other technologies. Communication device 108 can additionally comprise a serial (e.g., Universal Serial Bus (USB)) connection. Communication device 108 can be configured to emit communication signal 112. Communication device 108 and communication signal 112 can be configured to communicate with other systems of paving machine 10 or other external systems and devices. Signal 112 can additionally be configured to communicate with the various sensors and nozzles described herein, such as with a wireless signal.

I/O device 110 can comprise one or more devices for receiving input from paving machine 10, spray system 17 and screed system 14, or providing an output to said components via signal 114. I/O device 110 can comprise one or more of an alphanumeric input device (e.g., a keyboard), a user interface (UI) navigation device (e.g., a mouse), a display unit (e.g., a monitor or video display), which may all be integrated into a touch screen display.

Figure 6:
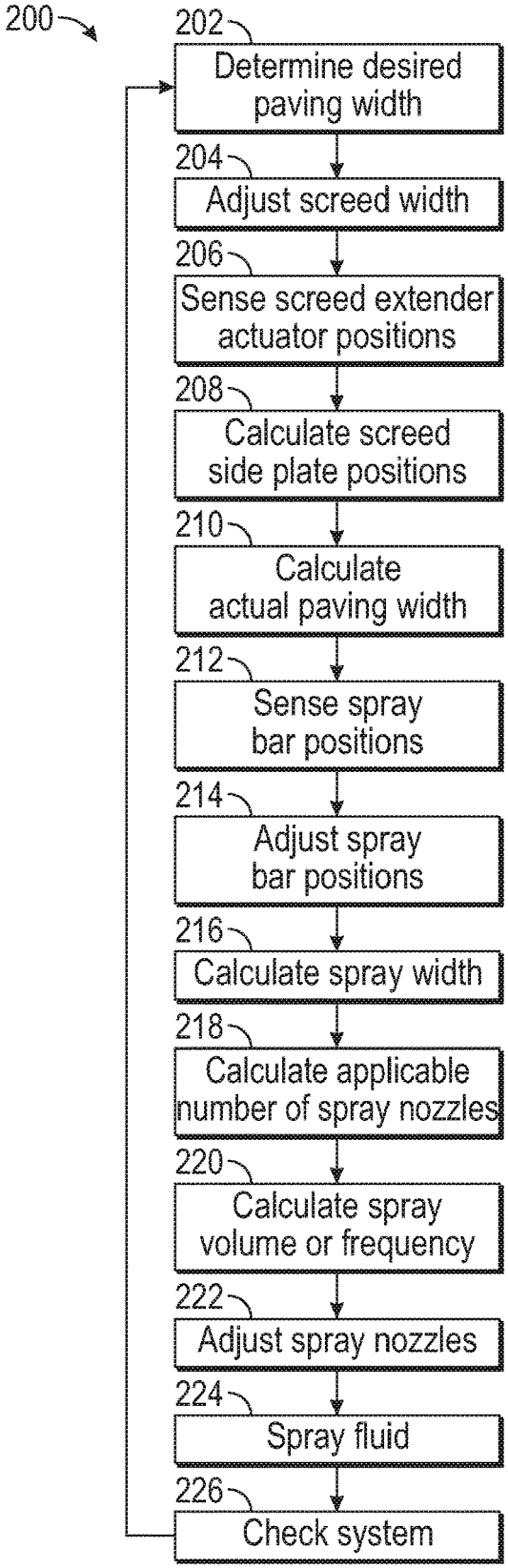
FIG. 6 is a line diagram showing methods for controlling a spray bar in a paving machine using the systems and devices of FIGS. 1-5.

FIG. 6 is a line diagram showing method 200 for controlling spray bars 36A and 36B in paving machine 10 using the systems and devices of FIGS. 1-5.

At step 202, a desired paving width for paving machine 10 can be determined. For example, a user or operator of paving machine 10 can determine, measure or estimate a width of a work surface, such as surface 32, over which a paved surface, such as mat 34, is to be applied. The desired paving width can be entered into I/O device 110 of controller 52.

At step 204, the width of screed system 14 can be adjusted to the desired paving width. For example, the distance between side plates 12A and 12B can be adjusted by operation of actuators 44A and 44B. Parameters for the distance between side plates 12A and 12B and the operation of actuators 44A and 44B can be input into I/O device 110 of controller 52, such as by an operator. The paving width can vary for different paving projects.

At step 206, the screed width can be sensed, such as by using sensors 46A and 46B. Sensors 46A and 46B can comprise in-cylinder position sensors included in actuators 44A and 44B, which can comprise hydraulic cylinders. In other examples, sensors 46A and 46B can comprise so-called yo-yo sensors that employ a drawstring pulled out by the actuating mechanism. Signal from sensors 46A and 46B including the position of actuators 44A and 44B can be sent to controller 52, such as at communication device 108.

At step 208, the position of screed side plates 12A and 12B can be calculated from the position signals from position sensors 46A and 46B. For example, the geometry of screed system 14 can be stored in memory 106 and processor 104 can calculate the positions of side plates 12A and 12B therefrom.

At step 210, the actual paving width of paving machine 10 can be calculated from the calculated position of side plates 12A and 12B. For example, the calculated width can be anywhere in the range of full paving width $W_{PF}$ to compact paving width $W_{PC}$. Processor 104 can determine the paving width passed on geometry of screed system 14 stored in memory 106. The actual paving width can be stored in memory 106 of controller 52.

At step 212, the position of spray bars, such as spray bars 36A and 36B can be sensed using, for example, position sensors 76A and 76B. Signals from sensors 76A and 76B including the position of spray bars 36A and 36B can be sent to controller 52, such as at communication device 108.

At step 214, the position of spray bars 36A and 26B can be adjusted, such as to match the spray width to the paving width. For example, controller 52 can operate actuators 58A and 58B to adjust the angles $\alpha_A$ and $\alpha_B$ between housings 54A and 54B and frame 74. Angles $\alpha_A$ and $\alpha_B$ are determined relative to a side of frame 74 that extends parallel to the paving path of screed system 14. The angles $\alpha_A$ and $\alpha_B$ can be used to determine the distance away from frame 74 that the distal-most spray nozzle is located, which can correspond to widths $W_{SA}$ and $W_{SB}$.

At step 216, the actual spray width can be calculated from angles $\alpha_A$ and $\alpha_B$. Controller 52 can check to make sure the actual spray width matches the paving width. Fore example, controller 52 can add the spray widths of fixed spray bars 38A-38C to widths $W_{SA}$ and $W_{SB}$ to determine the actual spray width. In some embodiments, step 216 can be executed before step 214. In any event, controller 52 can continue to calculate the spray width and adjust the spray bar positions until the spray width matches the paving width.

At step 218, the number of spray nozzles to be used on the spray bar can be determined. For example, the number of nozzles 66A, 64A. 62A and 60A of spray bar 36A desired to cover the spray width $W_{SA}$ can be determined. Spray nozzles toward the distal end of spray bar 36A located furthers away from hinge 56A can be deactivated first, as such nozzles become blocked by other nozzles closer to frame 74.

At step 220, the desired volume of sprayed material to be dispensed from the number of spray nozzles to be used can be calculated by controller 52. For example, nozzles 60A-66A can be pulsed to control the spray volume. That is, nozzles 60A-66A can be turned on and off. e.g., opened and closed, in rapid succession at intervals to control the spray volume. In other examples, the spray volume can be controlled using variable opening nozzles that can be held open in intermediate positions. The spray volume is controlled to apply an even layer of the sprayed material based on, for example, the speed of paving machine 10.

At step 222, the selected spray nozzles can be adjusted to their desired configuration for operation by controller 52. For example, controller 52 can shut-off or not activate some spray nozzles based on the calculated spray volume needed in step 220.

At step 224, fluid or emulsion can be sprayed onto the working surface, such as work surface 32, by the selected and configured nozzles after receiving appropriate instructions from controller 52.

At step 226, screed system 14 and spray system 17 can be checked to ensure that adequate spray coverage is being provided to the paved surface. As such, method 200 can return to step 202 or any other step of method 200 to perform a continuous, closed-loop feedback system check while paving machine 10 is operating.

INDUSTRIAL APPLICABILITY

The present application describes various systems and methods for controlling spray systems used in paving machines that can improve the performance and efficiency of the paving machine and the spray systems.

The spray systems can be operated to reduce the width of the paving machine, such as by moving adjustable spray bars closer to the frame of the paving machine, in order to increase the maneuverability of the paving machine.

The spray systems can additionally be operated to provide proper coverage of the sprayed material, such as by not coating surfaces not intended to be paved over, thereby reducing waste and avoiding messes and clean-up costs associated with removing sprayed material from surfaces.

The spray systems can also be operated to reduce waste incurred by over-spraying with too many spray nozzles, such as by shutting down or not activating spray nozzles that are not needed to cover the desired paving width, thereby reducing waste and avoiding re-work associated with over-sprayed working surfaces.

The spray systems can also be operated to reduce manual labor associated with adjusting spray bar position, deactivating spray nozzles and calculating spray widths.

The spray systems can also reduce the cost and assembly time of paving machines, by incorporating position sensors directly into actuators used to adjust the position of spray bars. Previous sensor systems have used separate sensors that required separate calibration and installation, which can increase manufacturing and operating costs. The stepper motors and cylinders described herein can self-calibrate and do not require additional space on the paving machine.

What is claimed is:

1. A system for controlling spray width in a paving machine, the system comprising:

a screed system having an adjustable width;

a first position sensor configured to sense a first width of the screed system;

a first spray bar having a position that is adjustable;

a plurality of spray nozzles mounted to the first spray bar;

a first spray bar actuator configured to adjust the position of the first spray bar; and a controller electronically coupled to the first position sensor and the first spray bar actuator, the controller configured to:

adjust the first spray bar actuator depending on the first width sensed by the first position sensor; and operate the spray nozzles to control a spray coverage of liquid sprayed by the spray nozzles over the first width.

2. The system of claim 1, further comprising:

a first spray bar sensor configured to sense the position of the first spray bar;

wherein the controller is electronically coupled to the first position sensor and is configured to calculate a first spray width of the first spray bar for adjusting the position of the first spray bar to match the first width.

3. The system of claim 2, wherein the controller is configured to operate all or fewer than all, but more than none, of the plurality of spray nozzles to cover the first spray width depending on the first width sensed by the first position sensor.

4. The system of claim 2, wherein the first spray bar actuator and the first spray bar sensor are integrated into a single device.

5. The system of claim 4, wherein:

the first spray bar actuator comprises a cylinder; and the first spray bar sensor comprises a position sensor integrated into the cylinder.

6. The system of claim 5, wherein the cylinder is selected from the group consisting of a hydraulic cylinder and a pneumatic cylinder.

7. The system of claim 4, wherein:

the first spray bar actuator comprises a stepper motor; and the first spray bar sensor comprises a rotary sensor integrated into the stepper motor.

8. The system of claim 1, wherein the adjustable position comprises an angular position of the spray bar relative to a side of the paving machine parallel to a direction of paving.

9. The system of claim 2, further comprising:

a second position sensor configured to sense a second width of the screed system;

a second spray bar having an adjustable position;

a second spray bar actuator configured to adjust the position of the second spray bar; and a second spray bar sensor configured to sense the position of the second spray bar.

10. A spray system for a paving machine, the spray system comprising:

a spray bar;

a mount connected to the spray bar for coupling the spray bar to the paving machine;

a plurality of spray nozzles coupled to the spray bar;

an actuator coupled to the spray bar, wherein the actuator includes a position sensor to sense a position of the actuator; and a controller configured to determine an orientation of the spray bar relative to the mount and a number of spray nozzles of the plurality of spray nozzles that should be activated based on output of the position sensor during a paving operation, wherein fewer spray nozzles of the plurality of spray nozzles are activated as a distance the spray bar extends away from the paving machine decreases.

11. The system of claim 10, wherein the controller is configured to match a spray width of the plurality of spray nozzles to a paving width of a screed extender.

12. The system of claim 11, further comprising a position sensor for sensing a screed width of the screed extender.

13. A method for spraying a coating during a paving machine operation, the method comprising:

sensing a paving width of a screed system during the paving machine operation;

determining a position of a spray bar from a position sensor attached to the spray bar;

adjusting an actuator incorporating the position sensor and coupled to the spray bar to change the position of the spray bar to adjust to the paving width; and calculating a spray width for the spray bar based on the paving width, wherein the spray width is determined by adjusting a spray bar width and adjusting a total number of spray nozzles to be activated.

14. The method of claim 13, wherein determining the position of the spray bar from the position sensor attached to the spray bar comprises determining the position from a position sensor integrated into the actuator.

15. The method of claim 14, wherein adjusting the actuator comprises adjusting a length of a hydraulic or pneumatic cylinder.

16. The method of claim 15, wherein determining a position of the spray bar comprises sensing a length of the hydraulic or pneumatic cylinder.

17. The method of claim 14, wherein adjusting the actuator comprises adjusting a stepper motor.

18. The method of claim 17, wherein determining a position of the spray bar comprises sensing a rotational position of the stepper motor.

19. The method of claim 13, wherein calculating the spray width for the spray bar based on the paving width comprises decreasing a number of spray nozzles of a plurality of spray nozzles mounted to the spray bar to operate for the spray width as the spray bar width decreases.

20. The method of claim 13, wherein sensing the paving width of the screed system comprises sensing a pair of distances that a pair of screed extenders are extended.

* * * * *